United States Patent [19]

Bober et al.

[11] 4,136,002

[45] Jan. 23, 1979

[54] DEVICE FOR ELECTROLYTICALLY APPLYING A METAL COAT ONTO A CYLINDER-SHAPED BODY

[75] Inventors: Heinrich Bober, Bern; Othmar Hollenstein, Dietikon, both of Switzerland

[73] Assignee: Peruhag A.G., Bern, Switzerland

[21] Appl. No.: 895,947

[22] Filed: Apr. 13, 1978

[30] Foreign Application Priority Data

Apr. 27, 1977 [CH] Switzerland ..... 005250/77

[51] Int. Cl.[2] ..... C25D 17/06; C25D 21/00; C25D 21/10

[52] U.S. Cl. ..... 204/225; 204/238; 204/273; 204/279; 204/297 R

[58] Field of Search ..... 204/238, 275, 279, 297 R, 204/213, 212, 225, 273

[56] References Cited

U.S. PATENT DOCUMENTS

| | | | |
|---|---|---|---|
| 3,503,856 | 3/1970 | Blackmore | 204/273 X |
| 3,573,187 | 3/1971 | Stakelbeck | 204/213 X |
| 3,660,265 | 5/1972 | Kangas | 204/213 X |

*Primary Examiner*—John H. Mack
*Assistant Examiner*—D. R. Valentine
*Attorney, Agent, or Firm*—Saul Jecies

[57] ABSTRACT

A device for applying by way of electrolysis a metal coat onto a cylinder-shaped body, especially for coppering a cylinder, with an outer tank and a process tank arranged above the outer tank, as well as with a circulation and filtering apparatus for the electrolyte. Two anode supports are installed in the process tank and connected to spray pipes. The supports are controlled by adjusting means arranged above the process tank. This latter is designed at its longitudinal ends with pockets whose inner walls are fitted with self-acting sealing elements for the projecting shaft ends of the cylinder.

4 Claims, 4 Drawing Figures

DEVICE FOR ELECTROLYTICALLY APPLYING A METAL COAT ONTO A CYLINDER-SHAPED BODY

The invention concerns a device for applying by way of electrolysis a metal coat onto a cylinder-shaped body, especially for coppering a cylinder, with an outer tank and a process tank arranged above this outer tank, as well as with a circulation and filtering apparatus for the electrolyte.

Up to this day are only known equipments for complete immersion of the cylinder, in which the electrolyte level in the process tank must be lowered at each change of cylinder and where, in addition, sealing devices must be installed or removed by hand. Sealing devices which do not need to be dismantled will allow only for cylinder immersions up to 50% maximum. Where the arrangement and the adjusting of anodes are concerned, the equipments are equipped today with lateral vertical or angular or V-shaped anode supports which, however, can be set up only in a straight line according to the cylinder size to be processed. This layout results in considerable difference in the distance separating the anodes and the cylinder.

With the device according to the invention, these drawbacks will be eliminated. This device is characterized in that two anode supports adjustable in shear-joint-type for the purpose of maintaining the distance with regard to cylinders of various diameters are installed in the process tank and connected to spray pipes, which supports are controlled by adjusting means arranged above the process tank, and in that the process tank is designed at its longitudinal ends with pockets whose inner walls are fitted with self-acting sealing elements for the projecting shaft ends of the cylinder.

Figure 1:
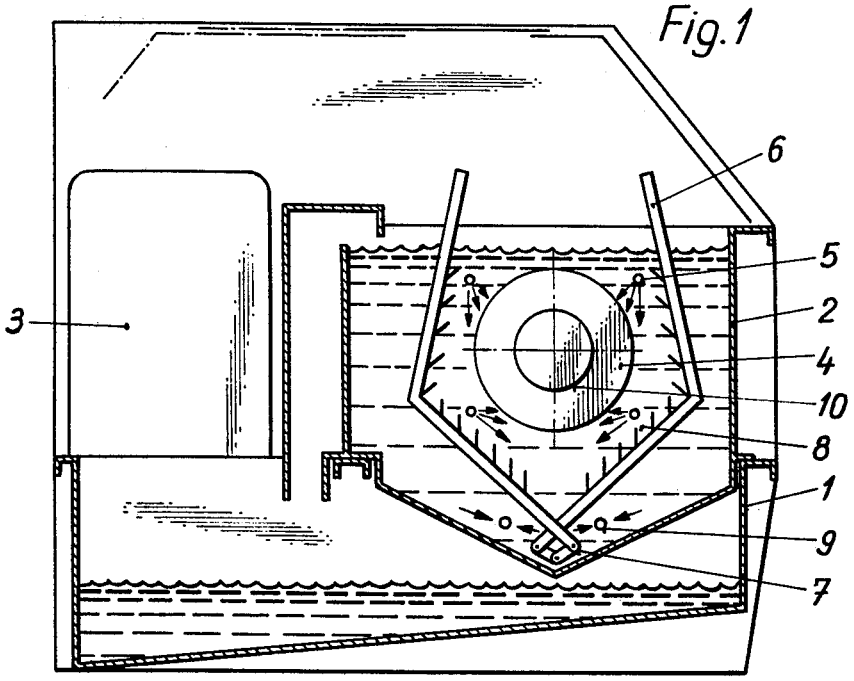
Figure 2:
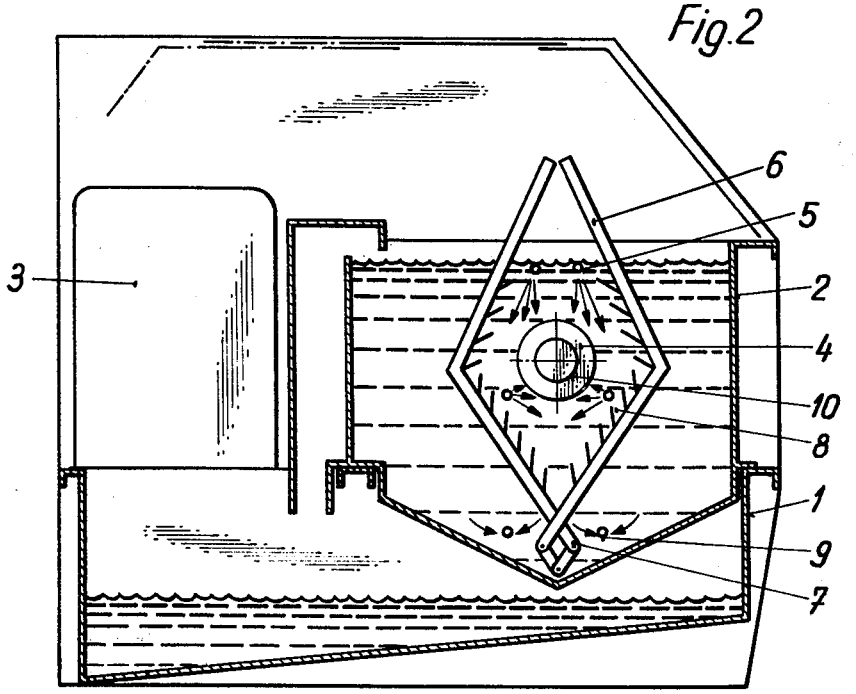
Figure 3:
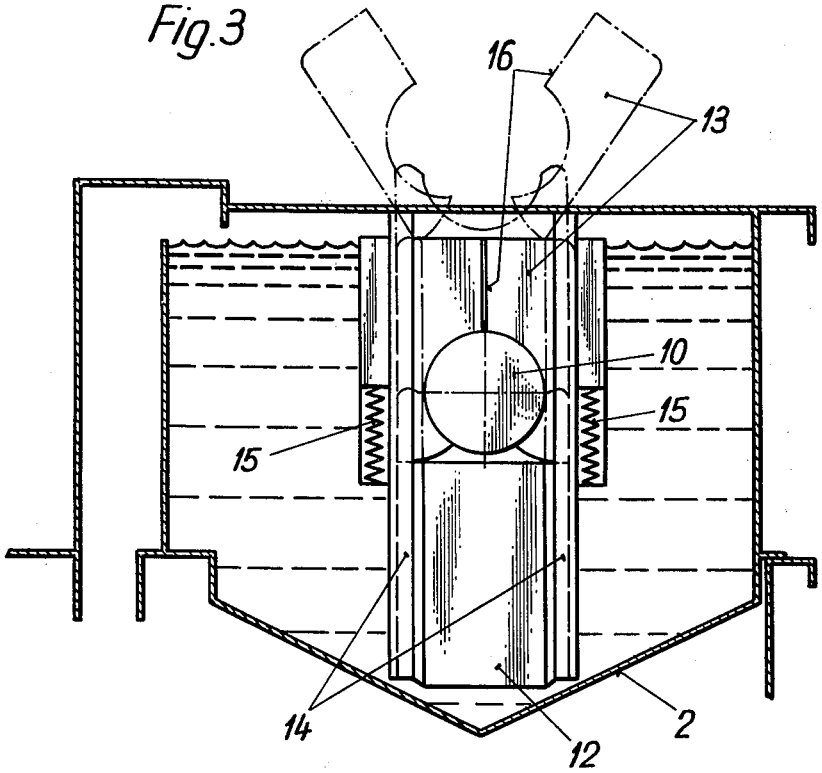
Figure 4:
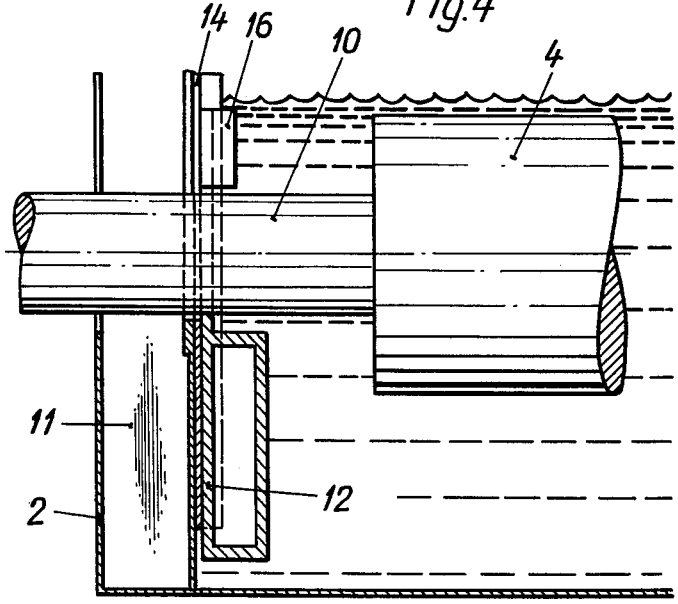

The drawings illustrate an embodiment of the object of the invention. The figures show:

FIG. 1 a schematic sectional view through the device and a relatively large cylinder, FIG. 2 a schematic sectional view according to FIG. 1, but with a relatively thin cylinder, FIG. 3 a view of the sealing elements for a shaft butt with completely immersed cylinder, and FIG. 4 a schematic longitudinal view through the process tank and the sealing of the shaft butt with completely immersed cylinder.

The device presented features an outer tank 1 (FIGS. 1, 2). On this tank is installed a process tank 2 next to which is arranged a circulation and filtering apparatus 3 for the electrolyte. The process tank 2 is filled with the electrolyte, in which is completely immersed a pressure cylinder drum 4 which is scheduled for coppering. The outer tank 1 serves to take up the electrolyte overflowing from process tank 2 and flowing through the leaks. In the longitudinal groove of the V-shaped floor section of process tank 2 are installed two anode supports 6, 7 connected with four spray pipes 5. These feature each two arms 6 with opposite angles in the middle, the bottom section of which is fitted with an articulated component 7 in the fashion of lazy tongs. The anode support arms 6 are designed as optional seats for anode plates 8 inclined toward the cylinder surface and/or with baskets filled with copper granulate. Thanks to a shear-type adjustment it will be possible to maintain a proper distance between anodes 8 and the cylinder 4 even where cylinder diameters are highly variable (cfr. FIGS. 1 and 2).

As adjusting means will serve adjusting spindles not shown by the drawing and swivel-mounted which can be secured, however, in a vertical position. In their fixed position, these adjusting spindles serve to raise and lower the anode supports 6, 7. In free swivelling arrangement, they are used to move the anode arms 6 against each other. The spray pipes 5 are connected to the anode arms 6, 7 and will spray in pairs and in a tangential direction onto the cylinder jacket and onto anodes 8 so that the cylinder 4 acting as a cathode is coated with filtered electrolyte as the copper anodes, too. At the bottom of the process tank 2 are installed two suction pipes 9 for the electrolyte. The suction pipes 9 as well as the spray pipes 5 are connected to the circulation and filtering apparatus.

Cylinder 4 is placed at both shaft ends 10 by means of an electromagnetic lifting gear not shown by the drawing into the process tank 2 and removed therefrom after the coppering operation. Process tank 2 is designed at its longitudinal ends with pockets 11 whose inner walls are fitted with self-acting sealing elements 12, 13 for the projecting shaft ends 1 of cylinder 4. As sealing elements will be used sealing slides 12, one of which will be placed under each corresponding shaft end 10 as well as two sealing disks 13 which can be swivelled at the top and laterally against the shaft end 10 and which are secured articulation-type to slide 12 (FIGS. 3, 4). The sealing slide 12 can be moved vertically on two guide rails 14. The bottom section is designed as a float affected by the lifting force in the electrolyte. In addition, the sealing slide 12 is subject to the force of two springs 15 pushing upwards.

When the cylinder 4 is immersed, the shaft end 10 will push the sealing slide 12 downwards. Both sealing disks 13 are swivelled by the guide rails 14 against the shaft end 10, after which their flanges 16 are superposed. This causes the shaft ends 10 to be sealed even with an immersion of cylinder 4 of 50–100% into the electrolyte, so that cylinder 4 can be removed without draining the process tank 2. During this operation, the sealing slide 12 is continuously pushed against the shaft end 10 until the latter swivels out the two dealing disks 13 at the top edge of the process tank 2.

Because of the adjustment of the anode clearance to any cylinder size and because of the very intensive filtering and circulation of the electrolyte, the copper coat applied features the finest crystal structure without any inclusion of foreign substance. Installing and removing the cylinder without draining the process tank will limit shut-down time to a minimum and thus provide maximum productivity.

We claim:

1. A device for applying by way of electrolysis a metal coat onto a cylinder-shaped body, especially for coppering a cylinder, with an outer tank and a process tank arranged above this outer tank, as well as with a circulation and filtering apparatus for the electrolyte, characterized in that two anode supports adjustable shear-joint-type for the purpose of maintaining the distance with regard to cylinders of various diameters are installed in the process tank and connected to spray pipes, which supports are controlled by adjusting means arranged above the process tank, and in that the process tank is designed at its longitudinal ends with pockets whose inner walls are fitted with self-acting sealing elements for the projecting shaft ends of the cylinder.

2. A device according to claim 1, characterized in that the anode supports each feature one pair of arms connected at the bottom in the fashion of lazy tongs and with opposite angles in their middle and controlled by adjusting spindles, whereby the spindles serve in fixed position to raise and lower the anode supports and will, in free swivelling position, serve to swivel the anode support arms against each other.

3. A device according to claim 2, characterized in that the anode support arms are designed to serve, optionally as seats for anode plates inclined toward the cylinder surface and/or for baskets filled with copper granulate.

4. A device according to claim 1, characterized in that vertically guided sealing slides are provided as sealing elements, one of each will be placed underneath the corresponding shaft end which slides are fitted at the top with two sealing disks swivelling laterally against the shaft end and that the sealing slide is subject to the force of two springs pushing upwards and to the lifting force of a float.

* * * * *

UNITED STATES PATENT AND TRADEMARK OFFICE

CERTIFICATE OF CORRECTION

PATENT NO. : 4,136,002

DATED : January 23, 1979

INVENTOR(S) : Heinrich Bober et al.

It is certified that error appears in the above-identified patent and that said Letters Patent are hereby corrected as shown below:

On the cover sheet, Assignee should read:

-- Graphicart Internationale Ausruestungsgesellschaft fuer graphische Kunst AG --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*